US005607353A

United States Patent [19]

Hutchings et al.

[11] Patent Number: 5,607,353

[45] Date of Patent: Mar. 4, 1997

[54] AIRLOCK SYSTEM

[75] Inventors: Adrian C. Hutchings, Cheshire; John Grimes, Greater Manchester; Kevin Shaw, Cheshire, all of United Kingdom

[73] Assignee: British Nuclear Fuels plc, Cheshire, United Kingdom

[21] Appl. No.: 292,191

[22] Filed: Aug. 19, 1994

[30] Foreign Application Priority Data

Aug. 23, 1993 [GB] United Kingdom ..... 9317513

[51] Int. Cl.[6] ..... F24F 9/00

[52] U.S. Cl. ..... 454/187; 34/242; 414/146; 414/217

[58] Field of Search ..... 414/146, 217, 414/221; 454/187; 34/242

[56] References Cited

U.S. PATENT DOCUMENTS

| | | | |
|---|---|---|---|
| 3,875,927 | 4/1975 | Trexler | 454/187 |
| 4,707,334 | 11/1987 | Gerhard | 414/217 X |
| 5,326,211 | 7/1994 | Critchley | 454/187 X |

FOREIGN PATENT DOCUMENTS

| | | |
|---|---|---|
| 1572558 | 6/1969 | France . |
| 61-282224 | 12/1986 | Japan . |
| 1201748 | 8/1970 | United Kingdom . |
| 2246403 | 1/1992 | United Kingdom . |

*Primary Examiner*—Harold Joyce
*Attorney, Agent, or Firm*—Nixon & Vanderhye P.C.

[57] ABSTRACT

In an airlock system, through which drums containing radioactive material are transferred into a containment area, a passage has an intermediate region, of reduced cross section relative to the inlet and outlet ends of the passage. The passage has a convergent inlet region and a divergent outlet region leading, respectively, to and from the intermediate region. The passage functions in the manner of a venturi so that an airstream is caused to flow along the passage towards the containment so as to inhibit the escape of atmosphere therefrom. A roller conveyor transfers the items through the airlock system and a detector monitors the atmosphere in the passage.

10 Claims, 1 Drawing Sheet

AIRLOCK SYSTEM

BACKGROUND OF THE INVENTION

1. Field of the Invention

The present invention relates to an airlock system for the transfer of items into a containment area. In particular, the invention relates to an airlock system whereby items such as drums or containers can be transferred without escape of atmosphere from the containment area.

2. Discussion of Prior Art

In the nuclear industry in particular there are processes where items have to be transferred into a containment, such as a glovebox, for treatment. The atmosphere within the containment may be radioactively contaminated and it is important to ensure that there is no escape of contaminants from the containment during the transfer procedure.

In one such process, drums containing radioactively contaminated waste require to be transferred into a glovebox. In the glovebox the drums are compacted and placed in larger drums which are subsequently removed for grouting treatment and then discharged to a suitable storage facility. When transferring the drums into the glovebox it is important to ensure that there is no escape of atmosphere from the glovebox. This is particularly a problem when the drums are transferred at a relatively high rate so as to satisfy the requirements of the drum compaction equipment.

SUMMARY OF THE INVENTION

According to the invention there is provided an airlock system for the transfer of items into a containment area, the system comprising a passage having an inlet opening at an inlet end thereof, an outlet opening at an outlet end thereof leading to the containment area, and an outlet door movable between open and closed positions at said outlet opening, wherein the passage has an intermediate region between the inlet and outlet ends, the intermediate region having a cross sectional area which is less than the cross sectional areas of the passage at its inlet and outlet ends, and wherein means are provided for producing an airstream which flows along the passage towards said containment area.

The passage preferably includes a convergent inlet region leading from the inlet end to the intermediate region and a divergent region leading from the intermediate region to the outlet end.

In a preferred embodiment the means for producing the airstream includes an inlet duct through which the airstream flows into the interior of the passage, the inlet duct communicating with the passage through a wall defining said convergent region.

The means for producing the airstream preferably further includes an outlet duct through which the airstream is discharged from the interior of the passage, the outlet duct communicating with the passage through a wall at an outlet region of the passage.

Preferably an inlet door, movable between open and closed positions, is provided for the inlet opening.

Detection means may be provided for monitoring the atmosphere within the passage.

Conveyor means are preferably provided for transporting the items through the passage.

The items transferred through the airlock system may be drums containing radioactive material.

BRIEF DESCRIPTION OF THE FIGURE

Embodiments of the invention will now be described, by way of example only, with reference to the accompanying FIG. 1, which shows a diagrammatic cross section through a venturi airlock system for transferring items into a containment area.

DETAILED DISCUSSION OF PREFERRED EMBODIMENTS

Figure 1:
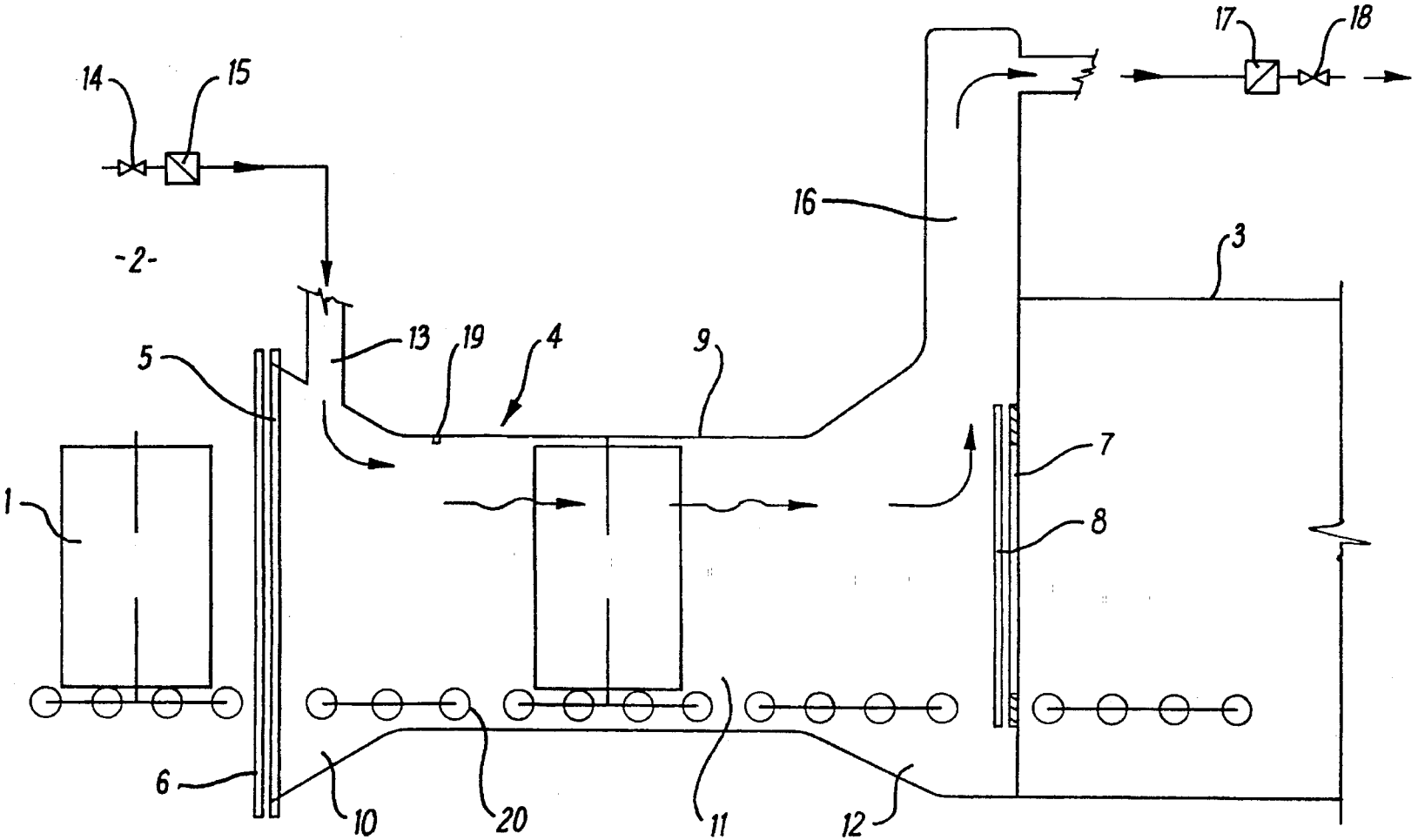

Referring to FIG. 1, a venturi airlock system is shown for transferring items, for example drums 1 containing radioactive material, from a delivery area 2 into a containment area 3, which may be a shielded glovebox.

The system comprises a passage 4 having an inlet opening 5 provided with an inlet door 6 which is movable between open and closed positions. Adjacent an outlet opening 7 for the passage is an outlet door 8, also movable between open and closed positions. The passage is formed by walls 9 which converge at an inlet region 10 of the passage from the inlet opening 5 to the beginning of an intermediate region 11. At an outlet region 12 of the passage the walls 9 diverge from the end of the intermediate region 11 towards the outlet opening 7. Thus, the cross sectional area of the intermediate region 11 is less than the cross sectional areas of the passage at its extreme inlet and outlet ends.

An air inlet duct 13, equipped with a valve 14 and a filter 15, communicates with the interior of the passage 4 through the passage wall 9 at the convergent inlet region 10. At the outlet region 12 an air outlet duct 16 leads from the passage 4 and is equipped with a filter 17, a valve or damper 18 and a suction fan (not shown) located downstream of the valve.

A detector 19 for monitoring the atmosphere for contaminating radiation in the passage is provided in the intermediate region 11 close to the inlet region 10. Thus, possible fault conditions arising in the system can be detected, thereby facilitating safe operation.

A roller conveyor 20 for transferring the drums 1 through the airlock system extends from the delivery area 2, along the bottom of the passage 4 and into the containment area 3.

In use, with both the inlet and outlet doors 6, 8 in their closed positions, the suction fan is operated to draw air into the passage through the air inlet duct 13. The inlet door 6 is opened to allow a drum 1 to be moved by the conveyor 19 through the inlet opening 5 into the intermediate region 9 of the passage. After closing the inlet door 6, the outlet door 8 is opened and the conveyor 20 is operated so as to transfer the drum 1 through the outlet opening 7 into the containment area 3. The outlet door 8 is then closed and the drum may be subjected to a volume reduction process and placed in a larger drum. When filled with compacted drums the larger drum is removed for grouting and discharged to a suitable storage site.

The airstream flowing along the passage 4 towards the outlet opening 7 is of sufficient strength to prevent the escape of contaminants, for example, radioactive substances, from the containment area 3 to the delivery area 2. Since the shape of the passage 4 is similar to that of a venturi tube the airstream accelerates through the narrow intermediate portion 9 and decelerates when in the outlet region 12. This enhances the ability of the airstream to prevent back diffusion of the contaminants along the passage. Optimum airstream characteristics are achieved when at least one drum, preferably two, is present in the intermediate region 9.

The system can be designed to operate satisfactorily without the inlet door 6. However, since this door serves as a safe contamination barrier in the event of fault conditions arising during operation of the airlock system, its inclusion in the system is desirable.

The system is capable of achieving a relatively high feed rate of drums into the containment area, as required by the demands of the compacting process. Typically, the feed rate may be of the order of one drum per ten minutes.

Although the invention has been described with reference to the transfer of drums into a radioactively contaminated glovebox, it will be appreciated that the principle of the airlock system can be utilised for other applications where items, particularly large items of irregular form, have to be transferred into an enclosure or containment without escape of atmosphere.

We claim:

1. An airlock system for the transfer of items from a delivery area into a containment area, the system comprising:

a passage having an inlet opening at an inlet end of said passage from said delivery area and an outlet opening at an outlet end of said passage leading to the containment area, an outlet door movable between open and closed positions at said outlet opening, wherein the passage has an intermediate region between the inlet and outlet ends, the intermediate region having a cross-sectional area which is less than the cross-sectional areas of the passage at its inlet and outlet ends, and means for producing an airstream which flows along the, passage towards said containment area, said airstream having a velocity in said intermediate region greater than a velocity at one of said inlet and outlet ends.

2. An airlock system in accordance with claim 1, wherein the passage includes a convergent inlet region leading from the inlet end to the intermediate region and a divergent region leading from the intermediate region to the outlet end.

3. An airlock system in accordance with claim 2, wherein the means for producing the airstream includes an inlet duct through which the airstream flows into the interior of the passage, the inlet duct communicating with the passage through a wall defining said convergent inlet region.

4. An airlock system in accordance with claim 3, wherein the means for producing the airstream further includes an outlet duct through which the airstream is discharged from the interior of the passage, the outlet duct communicating with the passage at an outlet region thereof.

5. An airlock system in accordance with claim 1, wherein an inlet door, movable between open and closed positions, is provided for the inlet opening.

6. An airlock system in accordance with claim 1, wherein detection means are provided for monitoring the atmosphere within the passage.

7. An airlock system in accordance with claim 1, wherein conveyor means are provided for transporting the items through the passage.

8. An airlock system in accordance with claim 1, wherein the items transferred through the airlock system comprise drums containing radioactive material.

9. An airlock system for the transfer of items from a delivery area into a containment area, the system comprising:

a passage having an inlet opening at an inlet end of said passage from said delivery area and an outlet opening at an outlet end of said passage leading to the containment area, an outlet door movable between open and closed positions at said outlet opening, wherein the passage has an intermediate region between the inlet and outlet ends, the intermediate region having a cross-sectional area which is less than the cross-sectional areas of the passage at its inlet and outlet ends, wherein the passage includes a convergent inlet region leading from the inlet to the intermediate region and a divergent region leading from the intermediate region to the outlet end, and means for producing an airstream which flows along the passage towards said containment area.

10. An airlock system for the transfer of drums containing radioactive material from a delivery area into a containment area contaminated with radioactive substances, the system comprising:

a passage having an inlet opening at an inlet end of said passage from said delivery area and an outlet opening at an outlet end of said passage leading to the containment area;

an outlet door movable between open and closed positions at said outlet opening, wherein the passage has an intermediate region between the inlet and outlet ends, the intermediate region having a cross-sectional area which is less than the cross-sectional areas of the passage at its inlet and outlet ends, wherein the passage includes a convergent inlet region leading from the inlet to the intermediate region and a divergent region leading from the intermediate region to the outlet end; and means for producing an airstream which flows along the passage towards said containment area, said means comprising an inlet duct communicating with the passage through a wall defining the convergent region and an outlet duct communicating with the passage at an outlet region thereof, whereby said intermediate region causes the airstream to accelerate so as to oppose the escape of radioactive substances from the containment area.

* * * * *